US006827608B2

(12) United States Patent
Hall et al.

(10) Patent No.: US 6,827,608 B2
(45) Date of Patent: Dec. 7, 2004

(54) HIGH FREQUENCY, BLIND MATE, COAXIAL INTERCONNECT

(75) Inventors: Richard D. Hall, Chandler, AZ (US); David M. Ellis, Chandler, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 10/227,609

(22) Filed: Aug. 22, 2002

(65) Prior Publication Data

US 2004/0038586 A1 Feb. 26, 2004

(51) Int. Cl.[7] ..... H01R 9/05

(52) U.S. Cl. ..... 439/578; 439/638; 439/851; 439/654

(58) Field of Search ..... 439/578, 579, 439/580, 582, 638, 851, 852, 856, 654

(56) References Cited

U.S. PATENT DOCUMENTS

| | | | | | |
|---|---|---|---|---|---|
| 2,449,073 | A | | 9/1948 | Johannesen | |
| 2,689,337 | A | | 9/1954 | Burtt et al. | |
| 3,091,748 | A | | 5/1963 | Takes et al. | |
| 3,601,776 | A | * | 8/1971 | Curl | 439/675 |
| 3,639,889 | A | | 2/1972 | Komadina | |
| 3,828,303 | A | | 8/1974 | Stadek et al. | |
| 4,035,053 | A | | 7/1977 | Spinner | |
| 4,453,796 | A | * | 6/1984 | Monroe | 439/581 |
| 4,580,862 | A | | 4/1986 | Johnson | |
| 4,591,222 | A | | 5/1986 | Shaffer | |
| 4,596,435 | A | * | 6/1986 | Bickford | 439/582 |
| 4,619,496 | A | | 10/1986 | Forney, Jr. et al. | |
| 4,655,526 | A | | 4/1987 | Shaffer | |
| 4,697,859 | A | | 10/1987 | Fisher, Jr. | |
| 4,759,729 | A | * | 7/1988 | Kemppainen et al. | 439/580 |
| 4,917,630 | A | | 4/1990 | Hubbard | |
| 4,925,403 | A | * | 5/1990 | Zorzy | 439/578 |
| 5,416,453 | A | | 5/1995 | Quan | |
| 5,595,499 | A | | 1/1997 | Zander et al. | |
| 5,683,255 | A | | 11/1997 | Menze | |
| 5,700,160 | A | * | 12/1997 | Lee | 439/578 |
| 6,126,487 | A | | 10/2000 | Rosenberger | |
| 6,166,615 | A | | 12/2000 | Winslow et al. | |
| 6,224,421 | B1 | | 5/2001 | Maturo, Jr. | |
| 6,267,621 | B1 | | 7/2001 | Pitschi et al. | |
| 6,590,478 | B2 | * | 7/2003 | Pluymers | 333/246 |

FOREIGN PATENT DOCUMENTS

| | | |
|---|---|---|
| DE | 3308438 | 8/1984 |
| FR | 2596587 | 10/1987 |

* cited by examiner

*Primary Examiner*—Truc T. T. Nguyen
(74) *Attorney, Agent, or Firm*—Joseph M. Homa

(57) ABSTRACT

A coaxial transmission medium connector is provided which includes an outer conductor portion for electrically coupling to the outer conductor of a coaxial transmission medium. The outer conductor portion includes a base portion, a plurality of cantilevered beams, and a plurality of slots extending about a longitudinal axis. Each of the cantilevered beams is coupled to the base portion at a transition portion and terminates at a distal end. A center conductor portion is disposed within the central bore of the outer conductor portion for electrically coupling to the inner conductor of the coaxial transmission medium. Related apparatus and methods are provided.

20 Claims, 5 Drawing Sheets

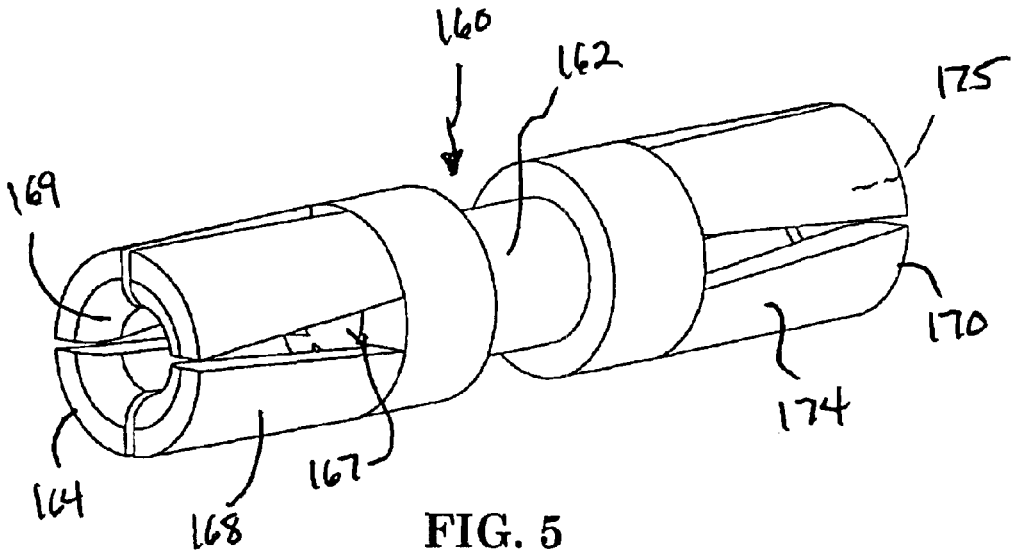
FIG. 5
FIG. 6
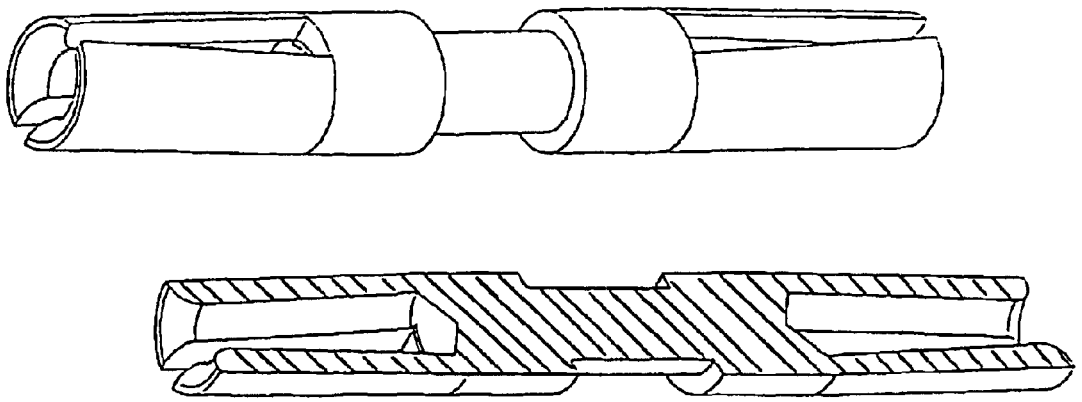
FIG. 7

HIGH FREQUENCY, BLIND MATE, COAXIAL INTERCONNECT

BACKGROUND OF THE INVENTION

1. Field of the Invention

The invention relates generally to electrical connectors for coupling together coaxial transmission media, such as coaxial cables, modules, ports, combinations thereof, and the like. The invention is well suited for application to connectors for connecting coaxial transmission media operating or operable in the microwave frequency range and similar frequency regimes.

2. Description of the Related Art

Coaxial transmission media for conveying information at microwave frequencies are often particularly characterized by their relatively small size which is not only a consequence of the operation frequency range, but is also particularly attributable to the applications and environments of the systems in which they are employed. Such systems, for example, may be found in sophisticated aircraft in which the size and weight of microwave electronics systems often must be small and light as possible, yet durable and reliable.

An example of a known coaxial transmission medium assembly is disclosed in U.S. Pat. No. 4,925,403 to Gilbert Engineering Company, Inc. (hereinafter "the '403 patent"). One of the figures of the '403 patent is reproduced as FIG. 10 of the accompanying drawings. As shown in FIG. 10, a female center conductor 35 electrically couples juxtaposed 26 and 27 to one another. The female center connector 35 comprises a center conductor 20 that is electrically coupled to the first 26 at points 36 and 37. The central conductor 20 is electrically coupled to the second 27 at points 38 and 39. The female center connector 35 further comprises outer beams 40 and 41 which mechanically engage terminal housings of the first 26 and the second 27, respectively. A retaining ring 44 electrically couples the outer beams 40 and 41 to one another. The retaining ring 44 may be integrally formed with the outer beams 40 and 41.

A problem that has been found to be associated with junctions affected by such a connector system is the mechanical stress that may be encountered in the outer beams 40 and 41. It has been found that axial misalignment, as shown in FIG. 10, may occur between the female center connector 35 and the first and second male 26 and 27. Axial misalignment between the males 26 and 27 and the female connector 35 may impart mechanical stress to the interface between, on the one hand, the retaining ring 44, and on the other hand, the first and second outer beams 40 and 41. The mechanical stress may cause beams 40 and 41 to break at the interface, thereby jeopardizing the mechanical and electrical connection between the males 26 and 27 and the female connector 35.

OBJECTS OF THE INVENTION

Accordingly, an object of the present invention is to provide a coaxial transmission medium connector that securely and reliably maintains the desired connection.

Another object of aspects of this invention is to provide such a coaxial transmission medium connector and a coaxial transmission medium assembly in which the effects of mechanical stress at the connection point can be accommodated without unduly affecting the performance of the connection.

Additional objects and advantages of the invention will be set forth in the description which follows, and in part will be apparent from the description, or may be learned by practice of the invention. The objects and advantages of the invention may be realized and obtained by means of the instrumentalities and combinations pointed out in the appended claims.

SUMMARY OF THE INVENTION

To achieve the foregoing objects and in accordance with the purposes of the invention as embodied and broadly described in this document, a coaxial transmission medium connector is provided for connecting to a coaxial transmission medium to form a coaxial conduction path. The coaxial transmission medium has an inner conductor and an outer conductor. It comprises an outer conductor portion for electrically coupling to the outer conductor of the coaxial transmission medium. The outer conductor portion comprises a base portion, a plurality of cantilevered beams, and a plurality of slots extending substantially circumferentially about a substantially non-conductive cavity and substantially about a longitudinal axis extending through the cavity. The cavity may comprise air, a dielectric, and the like. Each of the cantilevered beams is coupled to the base portion at a transition portion and terminates at a distal end. Each of the cantilevered beams has a respective tapering profile with respect to the longitudinal axis that tapers in a direction away from the base portion. A center conductor portion is disposed within the cavity for electrically coupling to the inner conductor of the coaxial transmission medium.

In a preferred embodiment, each of the cantilevered beams comprises a respective radial inner surface and a respective radial outer surface and the respective radial inner surface of each of the cantilevered beams is obliquely angled relative to the longitudinal axis when the cantilevered beams are in an unbiased state. In another preferred embodiment, the respective radial outer surface of each of the cantilevered beams is obliquely angled relative to the longitudinal axis when the cantilevered beams are in an unbiased state. It is also preferred that each of the cantilevered beams flares radially outward when the cantilevered beams are in an unbiased state. Each of the cantilevered beams also may flare radially inward when the cantilevered beams are in an unbiased state.

In the preferred embodiment, each of the cantilevered beams comprises a respective external detent at the distal end of the respective cantilevered beam.

It is preferred that there are at least six of the slots, and more preferably that there are six slots.

Each of the cantilevered beams preferably is coupled to the base portion at the transition portion and the transition portion comprises a non-orthogonal profile. The base portion preferably comprises an external surface, each of the cantilevered beams comprises an external surface, and the transition portion is positioned is positioned at the external surfaces of the base portion and each of the cantilevered beams. The non-orthogonal profile preferably comprises a curved profile, e.g., a radial profile. Such profiles may be useful in distributing stress in the outer conductor portion when the cantilevered beams are flexed radially inward. The tapering profile preferably is continuous and constant. It is preferred that the tapering profile spans at least 80 percent of the length of the cantilevered beams.

Each of the distal ends preferably is disposed substantially at an outer conductor portion reference plane, and the center conductor portion comprises an end disposed substantially at a center conductor portion reference plane that is non-coplanar with the outer conductor portion reference plane.

The center conductor portion reference plane preferably is longitudinally spaced from the outer conductor portion reference plane.

In accordance with another aspect of the invention, a coaxial transmission medium connector is provided for connecting first and second coaxial transmission media to form a coaxial conduction path. Each of the first and second coaxial transmission media have inner and outer conductors. The coaxial transmission medium connector comprises an outer conductor portion for electrically coupling the outer conductors of the first and second coaxial transmission media. The outer conductor portion comprises a base portion, a plurality of first cantilevered beams and a plurality of first slots extending substantially circumferentially about a substantially non-conductive first cavity and substantially about a longitudinal axis extending through the cavity. Each of the first cantilevered beams terminates at a first distal end. The outer cantilever portion also comprises a plurality of second cantilevered beams and a plurality of second slots extending substantially circumferentially about a substantially non-conductive second cavity and substantially about the longitudinal axis. Each of the second cantilevered beams terminates at a second distal end. Each of the first and second cantilevered beams is coupled to the base portion at a transition portion and each of the first and second cantilevered beams has a respective tapering profile that tapers in a direction away from the base portion. The connector further comprises a center conductor portion disposed within the first and second cavities for electrically coupling the inner conductors of the first and second coaxial transmission medium.

Preferably each of the first and second cantilevered beams comprises a respective radial inner surface and a respective radial outer surface, and the respective radial inner surfaces of each of the first and second cantilevered beams are obliquely angled relative to the longitudinal axis when the first and second cantilevered beams are in an unbiased state.

In the preferred embodiment, each of the first and second cantilevered beams comprises a respective radial inner surface and a respective radial outer surface, and the respective radial outer surfaces of each of the first and second cantilevered beams are obliquely angled relative to the longitudinal axis when the first and second cantilevered beams are in an unbiased state. It is also preferred that each of the first and second cantilevered beams flares radially outward when the first and second cantilevered beams are in an unbiased state, and/or each of the first and second cantilevered beams flares radially inward when the first and second cantilevered beams are in an unbiased state.

In the preferred embodiments, the first cantilevered beams each terminate at a respective first external detent at the first distal end, and the second cantilevered beams each terminate at a respective second external detent at the second distal end.

It is also preferred that there are at lease 6 first slots, and six second slots, and preferably that there are six first slots and six first beams as well as six second slots and six second beams., In the preferred embodiments, each of the first and second cantilevered beams is coupled to the base portion at the transition portion and the transition portion comprises a non-orthogonal profile. The base portion preferably comprises an external surface, each of the first and second cantilevered beams comprises an external surface, and the transition portion is positioned at the external surfaces of the base portion and each of the first and second cantilevered beams. The non-orthogonal profile may comprise a curved profile, e.g., a radial profile. The tapering profile again preferably is continuous and constant.

The cavity also may comprise air, a dielectric, and the like.

In the preferred embodiment, the center conductor portion comprises first and second ends disposed in respective first and second center conductor portion reference planes, each of the first distal ends is disposed substantially at a first outer conductor portion reference plane that is non-coplanar with respect to the first center conductor portion reference plane, and each of the second distal ends is disposed substantially at a second outer conductor portion reference plane that is non-coplanar with respect to the second center conductor portion reference plane.

In accordance with another aspect of the invention, a coaxial transmission medium assembly is provided. It comprises a coaxial transmission medium having an end and comprising a center conductor provided in proximity to the end of the coaxial transmission medium, an outer conductor provided in proximity to the end of the coaxial transmission medium; and a terminal housing electrically coupled to the outer conductor. The terminal housing comprises an inner surface which provides an inner receptacle chamber and a terminal housing opening communicating with the inner receptacle chamber.

The assembly also comprises a coaxial transmission medium connector comprising an electrically conductive outer conductor portion electrically coupled to the terminal housing. The outer conductor portion comprises a base portion, a plurality of cantilevered beams, and a plurality of slots extending substantially circumferentially about a substantially non-conductive cavity and substantially about a longitudinal axis extending through the cavity. Each of the cantilevered beams is coupled to the base portion at a transition portion and terminates at a distal end. Each of the cantilevered beams has a respective tapering profile with respect to the longitudinal axis that tapers in a direction away from the base portion. The cantilevered beams are sufficiently resilient to allow sufficient flexure of the cantilevered beams for inserting the cantilevered beams through the terminal housing opening and receiving the cantilevered beams against the inner surface of the inner receptacle chamber.

The assembly further comprises a center conductor portion disposed within the cavity and electrically coupled to the center conductor.

It is preferred that each of the cantilevered beams has a respective radial outer surface with a respective external detent. The external detents collectively provide a maximum outer diameter when the cantilevered beams are in an unbiased state. The inner surface of the terminal housing preferably has a recessed portion with an inner diameter that is smaller than the maximum outer diameter.

In accordance with another aspect of the invention, a coaxial transmission medium assembly is provided. It comprises a first coaxial transmission medium having a first end and comprising a first center conductor provided in proximity to the first end, a first outer conductor provided in proximity to the first end, and a first terminal housing electrically coupled to the first outer conductor. The first terminal housing comprises a first inner surface. The first inner surface provides a first inner receptacle chamber and a first terminal housing opening communicating with the first inner receptacle chamber.

The assembly also comprises a second coaxial transmission medium having a second end and comprising a second center conductor provided in proximity to the second end, a second outer conductor provided in proximity to the second end, and a second terminal housing electrically coupled to the second outer conductor. The second housing comprises a second inner surface. The second inner surface provides a second inner receptacle chamber and a second terminal housing opening communicating with the second inner receptacle chamber.

The assembly further comprises a coaxial transmission medium connector connecting the first and second coaxial transmission medium to form a coaxial conduction path. The coaxial transmission medium connector comprises an outer conductor portion electrically coupling the outer conductors of the first and second coaxial transmission media. The outer conductor portion has a centrally located opening and comprises a base portion and first and second biasing portions extending from the base portion. The biasing portions share a longitudinal axis and respectively terminate at a first distal end and a second distal end. The first and second distal ends respectively are situated along a first outer conductor portion reference plane and a second outer conductor portion reference plane. The first biasing portion comprises a plurality of first cantilevered beams and a plurality of first slots extending substantially longitudinally from the first distal end for circumferentially spacing the first cantilevered beams apart from one another. The second biasing portion comprises a plurality of second cantilevered beams and a plurality of second slots extending substantially longitudinally from the second distal end for circumferentially spacing the second cantilevered beams apart from one another. Each of the first and second cantilevered beams has a respective tapering profile that tapers in a direction away from the base portion. The first cantilevered beams are sufficiently resilient to allow sufficient flexure of the first cantilevered beams for inserting the first cantilevered beams through the first terminal housing opening and for receiving the first cantilevered beams against the first inner surface of the first inner receptacle chamber. The second cantilevered beams are sufficiently resilient to allow sufficient flexure of the second cantilevered beams for inserting the second cantilevered beams through the second terminal housing opening and for receiving the second cantilevered beams against the second inner surface of the second inner receptacle chamber.

A cavity is disposed in the centrally located opening of the outer conductor portion. The cavity comprising a central bore concentrically aligned with the centrally located opening.

An electrically conductive center conductor portion is provided for electrically coupling the first and second center conductors to one another. The center conductor portion comprises a mounting portion supported axially in the cavity for electrically insulating the center conductor portion from the outer conductor portion. The center conductor portion terminates at a first leading end and a second leading end opposite to one another. The first leading end is situated along a first center conductor portion reference plane and the second leading end is situated along a second center conductor portion reference plane.

In accordance with yet another aspect of the invention, a method is provided for assembling a coaxial transmission medium assembly. The method comprises providing a first coaxial transmission medium having a first end. The first coaxial transmission medium comprises a first center conductor, a first outer conductor, and a first terminal housing. The first center conductor and first center conductor are provided in proximity to the first end. The first terminal housing is electrically coupled to the first outer conductor and comprises a first inner surface. The first inner surface provides a first inner receptacle chamber and a first terminal housing opening communicating with the first inner receptacle chamber.

The method further comprises providing a second coaxial transmission medium having a second end. The second coaxial transmission medium comprises a second center conductor, a second outer conductor, and a second terminal housing. The second center conductor and the second outer conductor are provided in proximity to the second end. The second terminal housing is coupled to the second outer conductor and comprises a second inner surface. The second inner surface provides a second inner receptacle chamber and a second terminal housing opening communicating with the second inner receptacle chamber.

The method further comprises providing a coaxial transmission medium connector for connecting the first and second coaxial transmission media to form a coaxial conduction path. The coaxial transmission medium connector comprises an outer conductor portion for electrically coupling the outer conductors of the first and second coaxial medium transmission. The outer conductor portion has a centrally located opening and comprises a base portion and first and second biasing portions extending from the base portion. The first and second biasing portions share a longitudinal axis and respectively terminate at a first distal end and a second distal end. The first and second distal ends respectively are situated along a first outer conductor portion reference plane and a second outer conductor portion reference plane. The first biasing portion comprises a plurality of first cantilevered beams and a plurality of first slots extending substantially longitudinally from the first distal end for circumferentially spacing the first cantilevered beams apart from one another. The second biasing portion comprises a plurality of second cantilevered beams and a plurality of second slots extending substantially longitudinally from the second distal end for circumferentially spacing the second cantilevered beams apart from one another. Each of the first and second cantilevered beams has a respective tapering profile that tapers in a direction away from the base portion.

The method further comprises providing a cavity located in the centrally located opening of the outer conductor portion. The cavity which preferably provides an insulating function comprises a central bore concentrically aligned with the centrally located opening.

The method also comprises a center conductor portion for electrically coupling the inner conductors of the first and second coaxial transmission media. The center conductor portion comprises a mounting portion supported axially in the cavity for electrically insulating the center conductor portion from the outer conductor portion. The center conductor portion terminates at a first leading end and a second leading end opposite to one another. The first leading end is situated along a first center conductor portion reference plane and the second leading end is situated along a second center conductor portion reference plane.

The method also comprises flexing the first cantilevered beams inward and inserting the first cantilevered beams through the first terminal housing opening, receiving the inwardly flexed first cantilevered beams against the first inner surface of the first inner receptacle chamber for electrically coupling the outer conductor portion to the outer conductor of the first coaxial transmission medium, electrically coupling the first center conductor to the first leading end of the center conductor portion, flexing the second cantilevered beams inward and inserting the second cantilevered beams through the second terminal housing opening, receiving the inwardly flexed second cantilevered beams against the second inner surface of the second inner receptacle chamber for electrically coupling the outer conductor portion to the outer conductor of the second coaxial transmission medium and electrically coupling the second center conductor to the second leading end of the center conductor portion.

BRIEF DESCRIPTION OF THE DRAWINGS

The accompanying drawings, which are incorporated in and constitute a part of the specification, illustrate a presently preferred embodiments and methods of the invention and, together with the general description given above and the detailed description of the preferred embodiments and methods given below, serve to explain the principles of the invention. Of the drawings:

FIG. 5 is a perspective pictorial view of the electrically conductive center conductor portion of the coaxial transmission medium connector of FIG. 2;

FIG. 6 is a perspective pictorial view of another electrically conductive center conductor portion for a coaxial transmission medium connector according to an embodiment of the invention;

FIG. 7 is a sectional perspective view of the electrically conductive center conductor portion of FIG. 6;

DETAILED DESCRIPTION OF THE PREFERRED EMBODIMENTS AND PREFERRED METHODS

Figure 1:
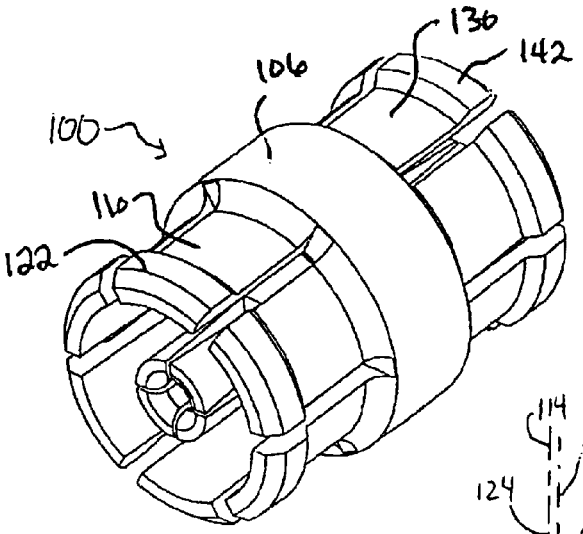
FIG. 1 is a perspective pictorial view of a coaxial transmission medium connector according to a preferred embodiment of the present invention.

Reference will now be made in detail to the presently preferred embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification, and appropriate equivalents.

It is to be noted that, as used in the specification and the appended claims, the singular forms "a," "an," and "the" may include plural referents unless the context clearly dictates otherwise.

In accordance with one aspect of the invention, a coaxial transmission medium connector is provided for connecting first and second coaxial transmission media to form a coaxial conduction path. The coaxial transmission medium connector is especially useful, for example, where the first and second coaxial transmission media are in a juxtaposed relationship and each have inner and outer conductor elements. As will be described in further detail, the coaxial transmission medium connector has wide application in the relevant art, and has particular use in connecting two fixedly juxtaposed components. The connector is not, however, limited to juxtaposed modules. Further, the connector may be employed with various combinations of components, such as cables, modules, ports, combinations thereof, and the like.

FIG. 1 illustrates a perspective pictorial view of an illustrative coaxial transmission medium connector, generally designated by reference numeral 100, according to a presently preferred embodiment of the invention. The coaxial transmission medium connector 100 also will be used herein below to describe and illustrate a preferred method according to the invention.

The coaxial transmission connector according to this aspect of the invention comprises an outer conductor portion for electrically coupling to the outer conductor of the coaxial transmission medium. The outer conductor portion comprising a base portion, a plurality of cantilevered beams and a plurality of slots extending substantially circumferentially about a substantially non-conductive cavity and substantially about a longitudinal axis extending through the cavity. Each of the cantilevered beams is coupled to the base portion at a transition portion and terminates at a distal end. Each of the cantilevered beams has a respective tapering profile with respect to the longitudinal axis that tapers in a direction away from the base portion.

In a related aspect of the invention, the connector comprises an outer conductor portion for electrically coupling the outer conductors of the first and second coaxial transmission media. The outer conductor portion comprises a base portion, a plurality of first cantilevered beams, and a plurality of first slots extending substantially circumferentially about a substantially non-conductive first cavity and substantially about a longitudinal axis extending through the cavity. Each of the first cantilevered beams terminates at a first distal end. The outer conductor portion further comprises a plurality of second cantilevered beams and a plurality of second slots extending substantially circumferentially about a substantially non-conductive second cavity and substantially about the longitudinal axis. Each of the second cantilevered beams terminates at a second distal end, and each of the first and second cantilevered beams is coupled to the base portion at a transition portion. Each of the first and second cantilevered beams has a respective tapering profile that tapers in a direction away from the base portion.

Figure 2:
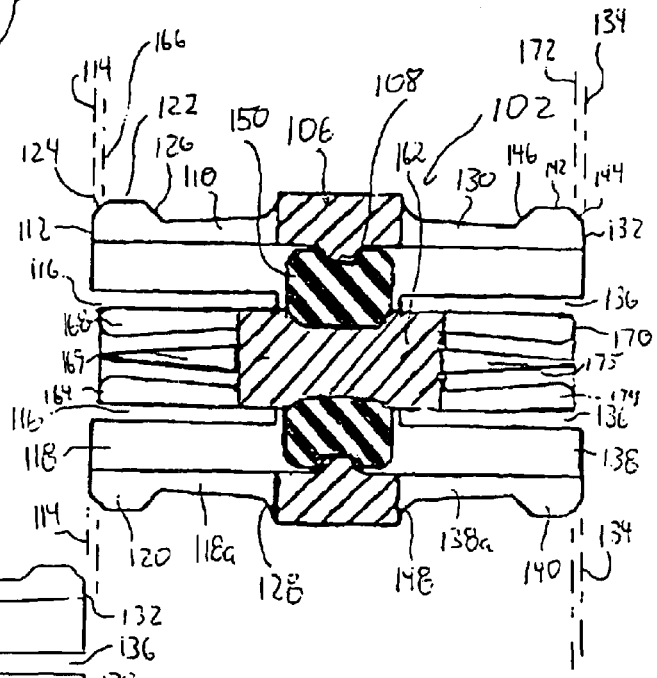
FIG. 2 is a side sectional view of the coaxial transmission medium connector of FIG. 1, depicting an electrically conductive outer conductor portion, an insulative insert, and an electrically conductive center conductor portion of the connector.
Figure 3:
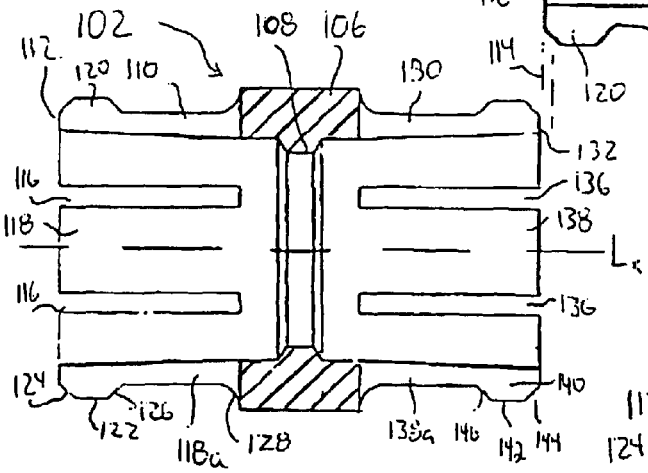
FIG. 3 is a side section view of an electrically conductive outer conductor portion similar to that of FIG. 2.
Figure 4:
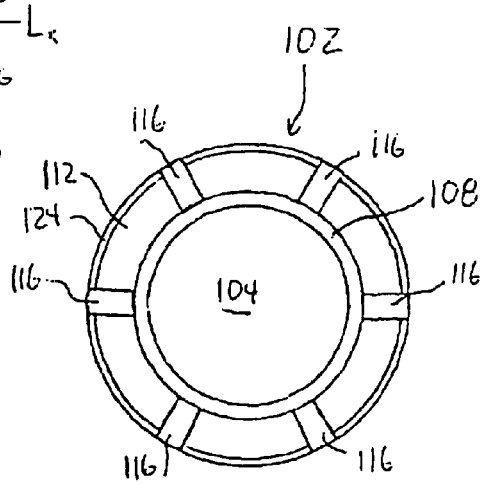
FIG. 4 is a front end elevational view of the electrically conductive outer conductor portion of FIG. 2.

Referring to FIGS. 2 and 4, an example of an electrically conductive outer conductor portion for electrically coupling the outer conductors of the first and second coaxial transmission media is designated by reference numeral 102. FIG. 3 depicts a substantially similar outer conductor portion to that shown in FIGS. 2 and 4, and therefore, the same reference numerals are used for designating like parts in FIGS. 2–4. Differences between the outer conductor portions of FIG. 2 and FIG. 3 will be described below. The outer conductor portion 102 has a centrally located cavity or opening 104 (FIG. 4), which is illustrated as having a circular shape to provide the outer conductor portion 102 with an annular appearance. The centrally located cavity 104 is not limited to a circular shape, and instead may undertake different shapes, such as that of a polygon (e.g., hexagonal). The outer conductor portion 102 comprises a base portion 106 and first and second biasing portions 110 and 130 extending from the base portion 106. Preferably, cavity 104 extends continuously through the base portion 106 and the first and second biasing portions 110 and 130. It is also preferred, but optional, that the base portion 106, the first biasing portion 110, and the second biasing portion 130 share a common longitudinal axis $L_x$, which is shown as an imaginary dashed line in FIG. 3. It should be noted that this longitudinal axis is a mathematical or geometric construct used to illustrate the principles of the invention, and not a physical component.

The base portion 106 has an inner nipple 108, as best shown in FIGS. 2 and 3. The inner nipple 108 may extend continuously around the inner surface of the base portion 106. Alternatively, the inner nipple 108 may comprise segments, such as diametrically opposed segments that are discontinuous from one another. The inner nipple 108 may be formed integrally with or separately from the remainder of the base portion 106.

The first biasing portion 110 terminates at a first distal end 112 situated along a first outer conductor portion reference plane 114. A plurality of first slots 116 extend substantially along a longitudinal direction from the first distal end 112 towards the base portion 106 to divide the first biasing portion 110 into a plurality of first cantilevered beams 118. The first slots 116 thereby circumferentially space the first cantilevered beams 118 from one another. Preferably, when viewed from an end view, as in FIG. 4, the first distal end 112 has an annular appearance with the first slots 116 uniformly circumferentially spaced from one another. In the illustrated embodiment, six first slots 116 divide the first biasing portion 110 into six first cantilevered beams 118. It is to be understood, however, that fewer or more slots 116 may be present. At least six slots and six beams per side are preferred, and six slots and six beams are more preferred.

Each of the first cantilevered beams 118 comprises a first external detent 120 proximate the first distal end 112. The first external detent 120 comprises a first plateau locking surface 122, a first beveled distal insertion face 124, and a first beveled proximal retention face 126. The first beveled proximal retention face 126 is in closer proximity to the base portion 106 than the first beveled distal insertion face 124. In an especially preferred embodiment, the first beveled distal insertion face 124 and the first beveled proximal retention face 126 are each angled at 45 degrees relative to the first plateau locking surface 122.

The outer conductor portion 102 preferably but optionally comprises a first transition portion 128 between the base portion 106 and the first cantilevered beams 118. The first transition portion 128 has a radial outer surface which preferably, but optionally, has an inwardly arcing, curved profile. This transition portion preferably has a non-orthogonal profile, and more preferably curved, e.g., radial or rounded. Although not wishing to be bound by any particular theory, it is believed that such profiles distribute stress in the outer conductor portion 102 when the first cantilevered beams 118 are flexed radially inward.

Extending between the first transition portion 128 and the first external detent 120 is a first tapering region 118*a* of the first cantilevered beams 118. The first tapering region 118*a* generally tapers in a direction away from the base portion 106. Preferably but not necessarily, each of the first cantilevered beams 118 has an identical tapering profile to the others, although the outer conductor portion 102 is not necessarily limited to this preferred embodiment. The first tapering region 118*a* may extend the entire length of the first cantilevered beams 118 between the first transition portion 128 and the first external detent 120. Alternatively, the first tapering region 118*a* may extend only part (e.g., at least 80 percent), but less than all of the length of the first cantilevered beams 118 between the first transition portion 128 and the first external detent 120. The first tapering region 118*a* may extend to the first transition portion 128, the first external detent 120, the first transition portion and the first external detent 120, or neither the first transition portion 128 nor the first external detent 120.

The second biasing portion 130 terminates at a second distal end 132 situated along a second outer conductor portion reference plane 134. A plurality of second slots 136 extend substantially along a longitudinal direction from the second distal end 132 towards the base portion 106 to divide the second biasing portion 130 into a plurality of second cantilevered beams 138. The second slots 136 thereby circumferentially space the second cantilevered beams 138 from one another. Preferably, the second distal end 132 has an annular appearance. In the illustrated embodiment, six second slots 136 divide the second biasing portion 130 into six second cantilevered beams 138. Preferably, the second slots 136 are uniformly circumferentially spaced from one another. It is to be understood, however, that fewer or more slots 136 may be present. The principles of slot numbers and spacing as described above for the first cantilevered beams apply to the second cantilevered beams as well.

Each of the second cantilevered beams 138 comprises a second external detent 140 proximate the second distal end 132. The second external detent 140 comprises a second plateau locking surface 142, a second beveled distal insertion face 144, and a second beveled proximal retention face 146. The second beveled proximal retention face 146 is in closer proximity to the base portion 106 than the second beveled distal insertion face 144. In an especially preferred embodiment, the second beveled distal insertion face 144 and the second beveled proximal retention face 146 are each angled at 45 degrees relative to the second plateau locking surface 142.

The outer conductor portion 102 preferably but optionally comprises a second transition portion 148 between the base portion 106 and the second cantilevered beams 138. The second transition portion 148 has a radial outer surface which preferably but optionally has an inwardly arcing, curved profile that may distribute stress in the outer conductor portion 102 when the second cantilevered beams 138 are flexed radially inward, as described above.

Extending between the second transition portion 148 and the second external detent 140 is a second tapering region 138*a* of the second cantilevered beams 138. The second tapering region 138*a* generally tapers in a direction away from the base portion 106. Preferably but not necessarily, each of the second cantilevered beams 138 has an identical tapering profile to the others, although the outer conductor portion 102 is not necessarily limited to this preferred embodiment. The second tapering region 138*a* may extend the entire length of the second cantilevered beams 138 between the second transition portion 148 and the second external detent 140. Alternatively, the second tapering region 138*a* may extend only part, but less than all of the length of the second cantilevered beams 138 between the second transition portion 148 and the second external detent 140. The second tapering region 138*a* may extend to the second transition portion 148, the second external detent 140, the second transition portion and the second external detent 140, or neither the second transition portion 148 nor the second external detent 140. The tapering of the second cantilevered beams optionally, but preferably is identical to that of the first cantilevered beams.

The outer conductor portion 102 is preferably but optionally made of an electrically conductive material, such as a metal or metal alloy. A preferred material for making the outer conductor portion 102 is beryllium copper, which optionally may be plated over another material (e.g., nickel). A portion or all of the outer conductor portion 102 may be made of other materials, such as different electrically conductive materials, rubbers, plastics, or the like.

As best shown in FIGS. 2 and 3, the first and second cantilevered beams 118 and 138 each comprise a respective radial inner surface and a respective radial outer surface. FIGS. 2 and 3 each depicts the first and second cantilevered beams 118 and 138 in an unbiased state. That is, the cantilevered beams 118 and 138 are not subjected to an inward or outward flexing force of a mated component. In the illustrative embodiment of FIG. 2, the respective radial outer surfaces of the first and second cantilevered beams 118 and 138 are obliquely angled relative to the longitudinal axis. On the other hand, in the illustrative embodiment of FIG. 3, the first and second cantilevered beams 118 and 138 have their respective radial inner surfaces obliquely angled relative to the longitudinal axis. It is also possible, but not shown, to have the respective radial inner surface and the respective radial outer surfaces of the first and second cantilevered beams 118 and 138 both obliquely angled relative to the longitudinal axis. Optionally, in the unbiased state the first and second cantilevered beams 118 and 138 may be flared radially outward or radially inward.

A cavity is disposed in the centrally located opening of the outer conductor portion, in the region defined by the interior of the cantilevered beams. The cavity comprises a central bore, which is preferably concentrically aligned with the centrally located opening.

Referring back to FIG. 2, in the illustrative embodiment the cavity and the cavity insert are represented by reference numerals 104 and 150, respectively. The inner and outer surfaces of the cavity insert 150 have substantially annular shapes, as shown in the drawings. Alternatively, the radial inner and outer surfaces of the cavity insert 150 may have non-circular shapes, such as polygonal shapes. Preferably, the cavity insert 150 comprises air, but it may comprise a dielectric material, such as polytetrafluoroethylene (e.g., Teflon®). Nipple 108 fixedly holds a cavity insert 150 in the base portion 106 of the outer conductor portion 102.

The shape of the cavity may be selected so that it offsets electromagnetic effects of the connector, e.g., to limit noise or other disturbances to the signal propagating across the conduction path caused by the connector. A conical profile, for example, may be used. The shape preferred in a given instance will depend upon the specific design application and operating environment and parameters. The shape may be selected to essentially tune the connector as desired.

The coaxial transmission medium connector further comprises a center conductor portion for electrically coupling the inner conductors of the first and second media. The center conductor portion according to presently preferred embodiments comprises a mounting portion supported axially in the insulative cavity for electrically insulating the center conductor portion from the outer conductor portion. In accordance with such embodiments, the center conductor portion terminates at a first leading end and a second leading end opposite to one another. The first leading end is situated along a first center conductor portion reference plane, which is preferably yet optionally longitudinally spaced apart from the first outer conductor portion reference plane. The second leading end is situated along a second center conductor portion reference plane, which is preferably yet optionally longitudinally spaced apart from the second outer conductor portion reference plane.

Referring now to FIGS. 2 and 5, an illustrative center conductor portion 160 is shown. The center conductor portion 160 comprises a mounting portion 162 supported axially in the cavity.

In the illustrated embodiment, the electrically conductive center conductor portion 160 terminates at a first leading end 164 and a second leading end 170 opposite to one another. As shown in FIG. 2, the first leading end 164 is situated along a first center conductor portion reference plane 166, which is preferably longitudinally spaced apart from the first outer conductor portion reference plane 114. Likewise, the second leading end 170 is situated along a second center conductor portion reference plane 172, which is preferably longitudinally spaced apart from the second outer conductor portion reference plane 134. As shown in FIGS. 2 and 3, the outer conductor portion reference planes 114 and 134 are located farther away longitudinally from the mounting portion 106 than the center conductor portion reference planes 166 and 172.

FIGS. 2 and 5 illustrate a preferred embodiment of the invention in which the center conductor portion 160 further comprise a plurality of first socket slots 167 extending substantially longitudinally from the first leading end 164 toward the mounting portion 162 to provide a plurality of first cantilevered tines 168. The first cantilevered tines 168 are situated in circumferentially spaced relationship to one another and provide a first central socket 169. The center conductor portion 160 of this preferred embodiment further comprise a plurality of second socket slots 173 extending substantially longitudinally from the second leading end 170 toward the mounting portion 162 to provide a plurality of second cantilevered tines 174. The second cantilevered tines 174 are situated in circumferentially spaced relationship to one another and provide a second central socket 175.

Optionally but preferably, each of the first and second cantilevered tines 168 and 174 has a tapered profile tapering toward the mounting portion 162. Also optionally, the first and second cantilevered tines 168 and 174 in an unbiased state may be flared, for example, flared radially inward.

The cavity electrically insulates the center conductor portion 160 from member 102. In the illustrative embodiment, the cavity spaces the first cantilevered beams 118 apart from the first cantilevered tines 168, and spaces the second cantilevered beams 138 apart from, the second cantilevered tines 174.

In the embodiment illustrated in FIGS. 2 and 5, the center conductor portion 160 includes four first cantilevered tines 168 and four second cantilevered tines 174. It is to be understood that the center conductor portion 160 may have a different number of cantilevered tines. For example, FIGS. 6 and 7 illustrate a center conductor portion having two first cantilevered tines and two second cantilevered tines, with each of the tines tapering toward the central mounting portion.

A preferred material for making the center conductor portion 160 is beryllium copper, which optionally may be plated over another material (e.g., nickel). A portion or all of the center conductor portion 160 may be made of other materials, such as different electrically conductive materials.

A method for assembling the illustrative coaxial transmission medium connector 100 will now be described in accordance with a further aspect of the invention. It is to be understood, however, that the coaxial transmission medium connector 100 of this embodiment may be assembled in different manners to that described herein.

In accordance with this method, the center conductor portion 160 is passed longitudinally through the central bore of the cavity insert 150 until the mounting portion 162 is received in the central bore. The assemblage of the center conductor portion 160 and the cavity insert 150 are then introduced longitudinally through one of the ends (112 or 132) of the outer conductor portion 102. The nipple 108 is placed into abutting relationship against the outer surface of the cavity insert 150 to retain the cavity insert 150 and center conductor portion 160 in place. Optionally, adhesive or other bonding agents may be used to permanently join these parts.

According to another aspect of the invention, a coaxial transmission medium assembly is provided for connecting first and second coaxial transmission media to one another.

Figure 8:
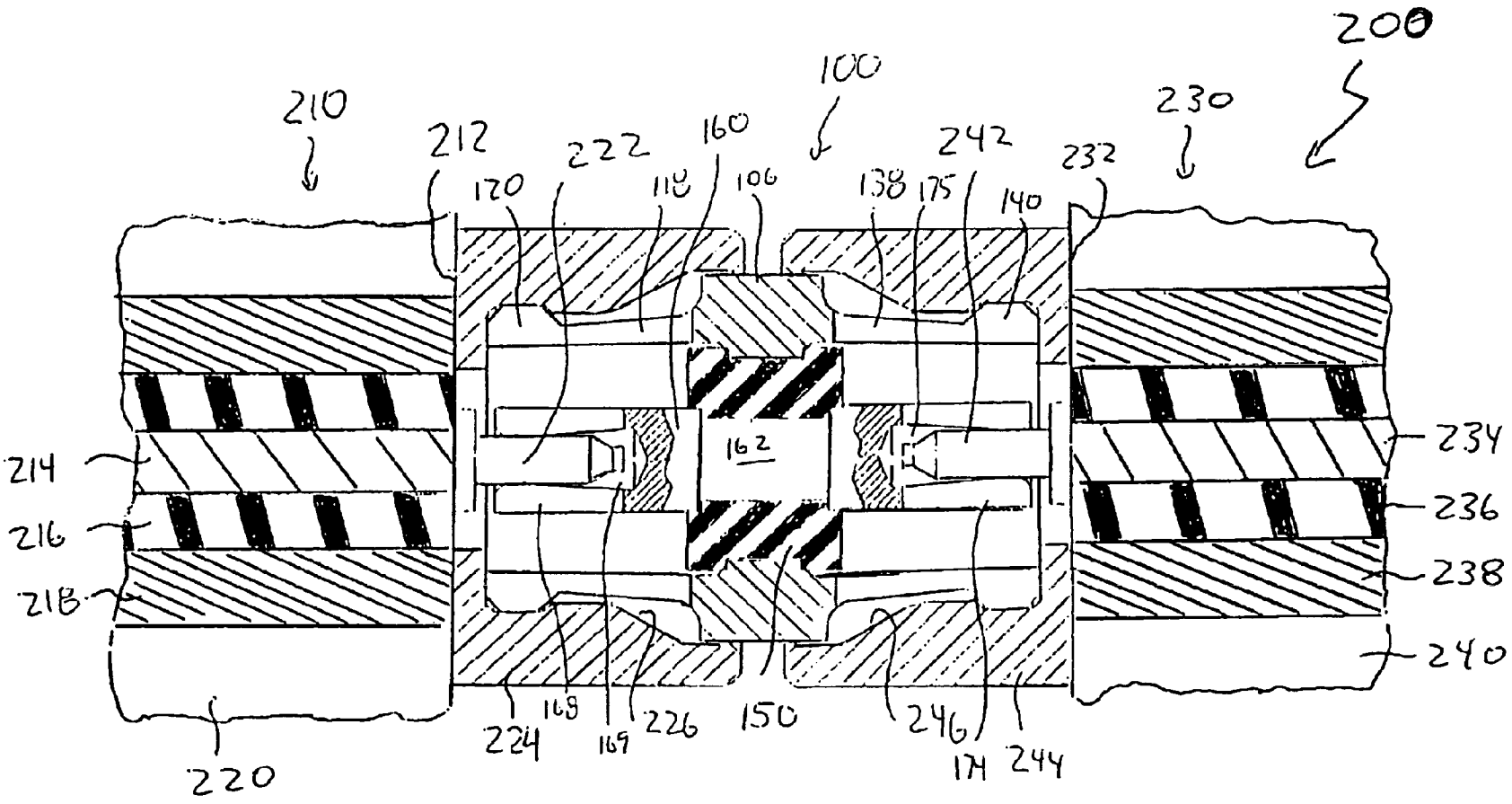
FIG. 8 is a side sectional view of a coaxial transmission medium assembly according to a preferred embodiment of the invention.

FIG. 8 illustrates an embodiment of a coaxial transmission medium assembly 200 of the present invention. The coaxial transmission medium assembly 200 comprises a first coaxial transmission medium 210 having a first end 212 and a second coaxial transmission medium 230 having a second end 232. The first coaxial transmission medium 210 comprises a first center conductor 214, a first dielectric 216 surrounding the first center conductor 214, a first outer conductor 218 surrounding the first dielectric 216, and a first outer body or jacket 220 surrounding the first outer conductor 218. The first center conductor 214 is terminated with a first pin 222 extending from the first end 212. The first outer conductor 218 is electrically coupled to a first terminal housing 224, which comprises a first inner surface 226 providing a first inner receptacle chamber and a first terminal housing opening communicating with the first inner receptacle chamber. The second coaxial transmission medium 230 comprises a second center conductor 234, a second dielectric 236 surrounding the second center conductor 234, a second outer conductor 238 surrounding the second dielectric 236, and a second outer body or jacket 240 surrounding the second outer conductor 238. The second center conductor 234 is terminated with a second pin 242 extending from the second end 232. The second outer conductor 238 is electrically coupled to a second terminal housing 244, which comprises a second inner surface 246 providing a second inner receptacle chamber and a second terminal housing opening communicating with the second inner receptacle chamber.

The coaxial transmission medium connector 100 of the embodiment illustrated in FIG. 8 is substantially identical to that described above in FIGS. 1, 2, and 4. For this reason, like reference numerals will be used to designate like parts in these figures, and the description of the connector 100 provided above will not be repeated in full in the interest of brevity.

As described above, the coaxial transmission medium connector 100 comprises first and second cantilevered beams 118 and 138 having respective radial outer surfaces, which preferably have respective first and second external detents 120 and 140. The first and second external detents 120 and 140 collectively provide a maximum outer diameter of the first and second cantilevered beams 118 and 138 when in an unbiased state. The first external detents 120 are received in a recessed portion of the first inner surface 226 of the first terminal housing 224. The recessed portion of the first inner surface 226 preferably has an inner diameter that is smaller than the maximum outer diameter (in the unbiased state) of the first external detents 120. Likewise, the second external detents 140 are received in a recessed portion of the second inner surface 246 of the second terminal housing 244. The recessed portion of the second inner surface 246 preferably has an inner diameter that is smaller than the maximum outer diameter (in the unbiased state) of the second external detents 140. In this coupled state, the first cantilevered beams 118 are flexed radially inward and, due to their resilient nature, impart a biasing force against first inner surface 226 of the first terminal housing 224 to lock the first cantilevered beams 118 in place. Similarly, the second cantilevered beams 138 are flexed radially inward and, due to their resilient nature, impart a biasing force against the second inner surface 246 of the second terminal housing 246 to lock the second cantilevered beams 138 in place. In a preferred yet optional embodiment, when locked into their respective first and second terminal housings 224 and 244, the first and second cantilevered beams 118 and 138 are flared radially inwardly.

Simultaneously, the first pin 222 is received in the first central socket 169 and is placed in surface contact with the first cantilevered tines 168 of center conductor portion 160. The second pin 242 is received in the second central socket 175 and is placed in surface contact with the second cantilevered tines 174 of center conductor portion 160. Preferably, the first and second cantilevered tines 168 and 174 respectively grip the first and second pins 222 and 242. The center conductor portion 160 thereby electrically couples the first and second pins 222 and 242 to one another.

A method of assembling the illustrative coaxial transmission medium assembly 200 will now be described in accordance with a further aspect of the invention. It is to be understood, however, that the coaxial transmission medium assembly 200 of this embodiment may be assembled in different manners to that specifically described below.

In accordance with this method, the first cantilevered beams 118 are flexed radially inward and are inserted into the first terminal housing 224. The first beveled distal insertion face 124 may be slid along the first inner surface 226 until the first plateau locking surface 122 comes to rest against the recess of the first inner surface 226 of the first terminal housing 224. The surface contact between the first cantilevered beams 118 and the first terminal housing 224 electrically couples the outer conductor portion 102 to the first outer conductor 218. The inclination of the first beveled proximal retention face 126 of the first external detent 120 acts as a locking mechanism by inhibiting movement of the first cantilevered beams 118 longitudinally away from the first terminal housing 224.

As the first cantilevered beams 118 are flexed radially inward, the first cantilevered beams, and more particularly the interfaces of the first cantilevered beams 118 and the base portion 106, are subjected to stress. While not wishing to be bound to theory, the inventors have found that the tapered profile of the first cantilevered beams 118 can distribute the stress along the length of the beams 118, rather than allowing the stress to localize at the interface of the first cantilevered beams 118 and the base portion 106. The optional non-orthogonal or curved transition portion 128 may further reduce the mechanical stress at the beam/base portion interface.

Simultaneously, the first pin 222 is inserted through the first leading end 164 of the first cantilevered tines 168 and into the first central socket 169 for electrically coupling the pin 222 to the center conductor portion 160.

The second coaxial transmission medium 230 may be coupled to the coaxial transmission medium connector 100 in the identical manner, either simultaneously with or subsequent to the coupling of the first coaxial transmission medium 210 to the connector 100.

Figure 9:
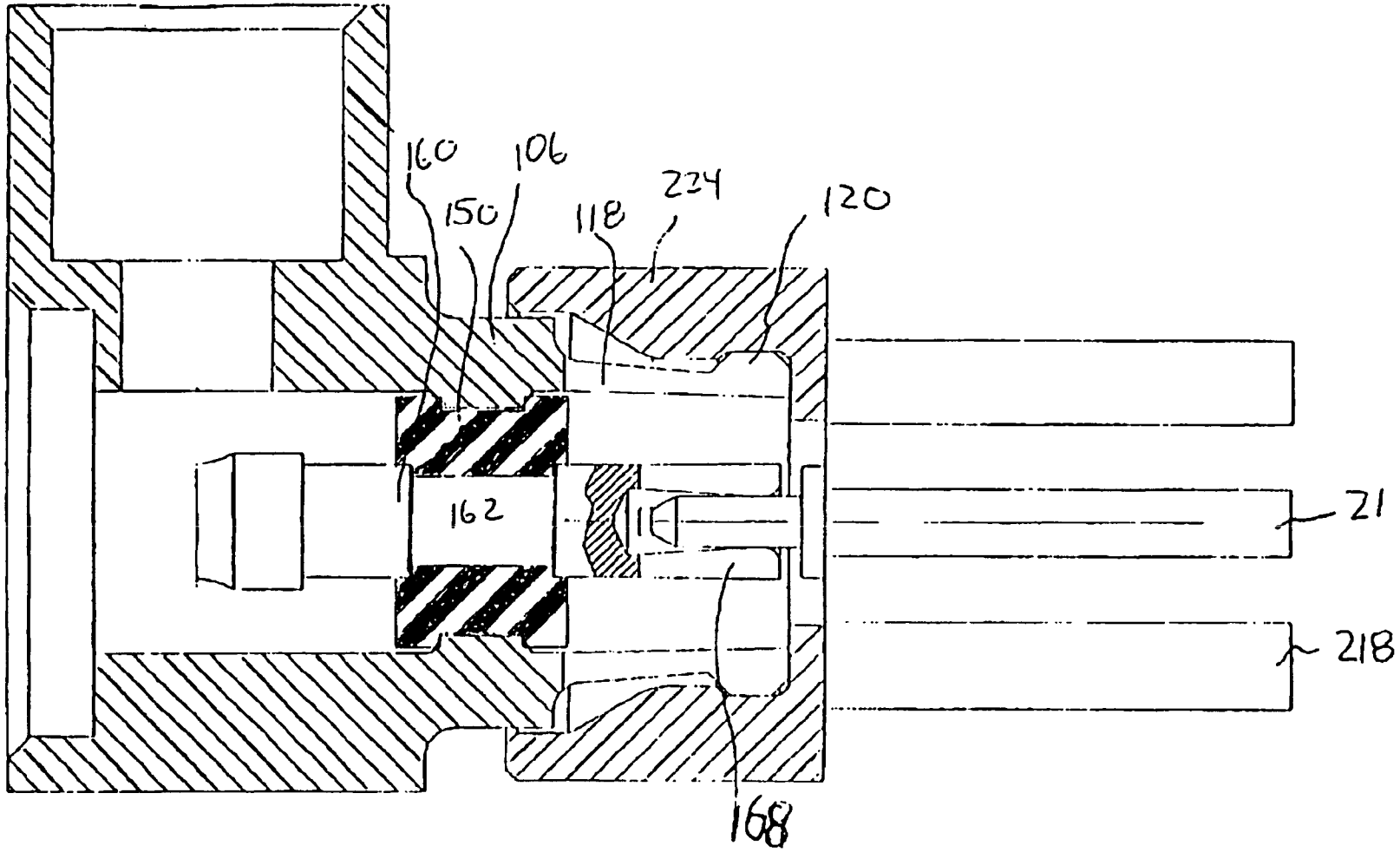
FIG. 9 is a side sectional view of a coaxial transmission medium assembly according to another preferred embodiment of the invention.
Figure 10:
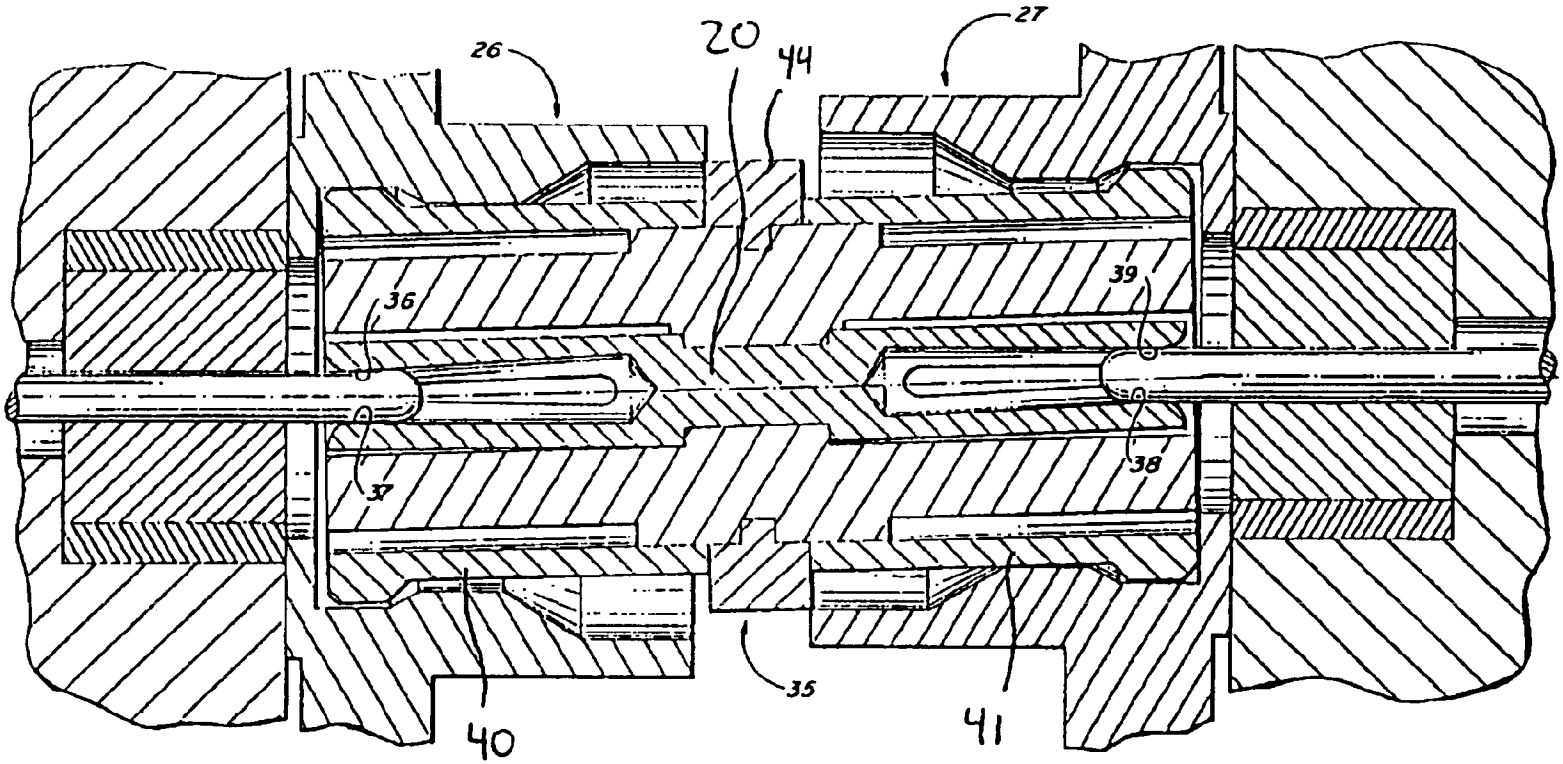
FIG. 10 (Prior Art)
FIG. 10 is a cross sectional view of a conventional coaxial transmission medium connector.

The connector 100 illustrated of FIGS. 1–8 is substantially symmetrical. It is to be understood, however, that the present invention also encompasses connectors that are not symmetric. For example, the first cantilevered beams 118 may have different dimensions and/or different configurations than the second cantilevered beams 138, for example, for accommodating different type and different size coaxial transmission media. FIG. 9 illustrates a coaxial transmission medium connector that does not possess symmetrical opposite ends located along a common longitudinal axis. Again, similar parts are designated by identical reference numerals.

Additional advantages and modifications will readily occur to those skilled in the art. For example, the first and second coaxial transmission media may have female inner conductors for mating with a male center conductor portion of the coaxial transmission medium connector. Therefore, the invention in its broader aspects is not limited to the specific details, representative devices and methods, and illustrative examples shown and described. Accordingly, departures may be made from such details without departing from the spirit or scope of the general inventive concept as defined by the appended claims and their equivalents.

What is claimed is:

1. A coaxial transmission medium connector for connecting to a coaxial transmission medium to form a coaxial conduction path, the coaxial transmission medium having an inner conductor and an outer conductor, the coaxial transmission medium connector comprising:

an outer conductor portion for electrically coupling to the outer conductor of the coaxial transmission medium, the outer conductor portion comprising a base portion, a plurality of cantilevered beams and a plurality of slots, extending substantially circumferentially about a a longitudinal axis and defining a central bore, each of the cantilevered beams being coupled to the base portion at a transition portion and terminating at a distal end;

a center conductor portion disposed within the central bore for electrically coupling to the inner conductor of the coaxial transmission medium, the center conductor portion comprising a plurality of cantilevered tines circumferentially spaced about the longitudinal axis and forming a central socket therebetween, the center conductor portion and the outer conductor portion forming an annular cavity therebetween, wherein the plurality of cantilevered beams and the plurality of cantilevered tines are spaced apart; and a cavity insert disposed within the central bore and fixed to the base portion of the outer conductor portion, wherein the center conductor portion is held within the central bore by the cavity insert.

2. A coaxial transmission medium connector according to claim 1, wherein:

each of the cantilevered beams comprises a respective radial inner surface and a respective radial outer surface; and the respective radial inner surface of each of the cantilevered beams is obliquely angled relative to the longitudinal axis when the cantilevered beams are in an unbiased state.

3. A coaxial transmission medium connector according to claim 1, wherein:

each of the cantilevered beams comprises a respective radial inner surface and a respective radial outer surface; and the respective radial outer surface of each of the cantilevered beams is obliquely angled relative to the longitudinal axis when the cantilevered beams are in an unbiased state.

4. A coaxial transmission medium connector according to claim 1, wherein each of the cantilevered beams comprises a respective external detent at the distal end of the respective cantilevered beam.

5. A coaxial transmission medium connector according to claim 1, wherein the plurality of slots comprise six of the slots.

6. A coaxial transmission medium connector according to claim 1, wherein the plurality of slots consists of six of the slots.

7. A coaxial transmission medium connector according to claim 1, wherein each of the cantilevered beams is coupled to the base portion at the transition portion and the transition portion comprises a non-orthogonal profile.

8. A coaxial transmission medium connector according to claim 7, wherein:

the base portion comprises an external surface;

each of the cantilevered beams comprises an external surface; and the transition portion is positioned at the external surfaces of the base portion and each of the cantilevered beams.

9. A coaxial transmission medium connector according to claim 7, wherein the non-orthogonal profile comprises a curved profile.

10. A coaxial transmission medium connector according to claim 7, wherein the non-orthogonal provide comprises a radial profile.

11. A coaxial transmission medium connector according to claim 1, wherein the transition portion comprises a non-orthogonal profile for distributing stress in the outer conductor portion when the cantilevered beams are flexed radially inward.

12. A coaxial transmission medium connector according to claim 1, wherein the slots are circumferentially spaced uniformly relative to one another.

13. A coaxial transmission medium connector according to claim 1, wherein each of the cantilevered beams having a respective tapering profile with respect to the longitudinal axis that tapers in a direction away from the base portion, and wherein the tapering profile is continuous and constant.

14. A coaxial transmission medium connector according to claim 13, wherein the cantilevered beams each have a length; and wherein the tapering profile spans at least 80 percent of the length of the cantilevered beams.

15. A coaxial transmission medium connector according to claim 1, wherein:

each of the distal ends is disposed substantially at an outer conductor portion reference plane; and the center conductor portion comprises an end disposed substantially at a center conductor portion reference plane that is non-coplanar with the outer conductor portion reference plane.

16. A coaxial transmission medium connector according to claim 15, wherein the center conductor portion reference plane is longitudinally spaced from the outer conductor portion reference plane.

17. A coaxial transmission medium connector for connecting first and second coaxial transmission media to form a coaxial conduction path, each of the first and second coaxial transmission media having inner and outer conductors, the coaxial transmission medium connector comprising:

an outer conductor portion for electrically coupling the outer conductors of the first and second coaxial transmission media, the outer conductor portion being provided with a central bore, the outer conductor portion comprising a base portion, a plurality of first cantilevered beams and a plurality of first slots extending substantially circumferentially about a longitudinal axis and defining a first part of the central bore, each of the first cantilevered beams terminating at a first distal end, and a plurality of second cantilevered beams and a plurality of second slots extending substantially circumferentially about the longitudinal axis and defining a second part of the central bore, each of the second cantilevered beams terminating at a second distal end, each of the first and second cantilevered beams being coupled to the base portion; and a center conductor portion disposed within the central bore for electrically coupling the inner conductors of the first and second coaxial transmission media, the center conductor portion comprising a plurality of first cantilevered tines circumferentially spaced about the longitudinal axis and forming a first central socket therebetween, the plurality of first cantilevered tines and the outer conductor portion forming a first annular cavity therebetween, wherein the plurality of first cantilevered beams and the plurality of first cantilever tines are spaced apart, the center conductor portion further comprising a plurality of second cantilevered tines circumferentially spaced about the longitudinal axis and forming a second central socket therebetween, the plurality of second cantilevered tines and the outer conductor portion forming a second annular cavity therebetween, wherein the plurality of second cantilevered beams and the plurality of second cantilever tines are spaced apart; and a cavity insert disposed within the central bore and fixed to the base portion of the outer conductor portion, wherein the center conductor portion is held within the central bore by the cavity insert.

18. A coaxial transmission medium assembly comprising:

a coaxial transmission medium having an end and comprising a center conductor provided in proximity to the end of the coaxial transmission medium, an outer conductor provided in proximity to the end of the coaxial transmission medium; and a terminal housing electrically coupled to the outer conductor, the terminal housing comprising an inner surface, the inner surface providing an inner receptacle chamber and a terminal housing opening communicating with the inner receptacle chamber; and a coaxial transmission medium connector comprising:

an outer conductor portion for electrically coupling to the outer conductor of the coaxial transmission medium, the outer conductor portion comprising a base portion, a plurality of cantilevered beams and a plurality of slots, extending substantially circumferentially about a longitudinal axis and defining a central bore, each of the cantilevered beams being coupled to the base portion at a transition portion and terminating at a distal end;

a center conductor portion disposed within the central bore and electrically coupled to the center conductor of the coaxial transmission medium, the center conductor portion comprising a plurality of cantilevered tines circumferentially spaced about the longitudinal axis and forming a central socket therebetween, the center conductor portion and the outer conductor portion forming an annular cavity therebetween, wherein the plurality of cantilevered beams and the plurality of cantilevered tines are spaced apart; and a cavity insert disposed within the central bore and fixed to the base portion of the outer conductor portion, wherein the center conductor portion is held within the central bore by the cavity insert.

19. A coaxial transmission medium assembly comprising:

a first coaxial transmission medium having a first end and comprising a first center conductor provided in proximity to the first end, a first outer conductor provided in proximity to the first end, and a first terminal housing electrically coupled to the first outer conductor, the first terminal housing comprising a first inner surface, the first inner surface providing a first inner receptacle chamber and a first terminal housing opening communicating with the first inner receptacle chamber;

a second coaxial transmission medium having a second end and comprising a second center conductor provided in proximity to the second end, a second outer conductor provided in proximity to the second end, and a second terminal housing electrically coupled to the second outer conductor, the second housing comprising a second inner surface, the second inner surface providing a second inner receptacle chamber and a second terminal housing opening communicating with the second inner receptacle chamber; and a coaxial transmission medium connector connecting the first and second coaxial transmission mediums to form a coaxial conduction path, the coaxial transmission medium connector comprising an outer conductor portion electrically coupling the outer conductors of the first and second coaxial transmission mediums, the outer conductor portion having a central bore and comprising a base portion and first and second biasing portions extending from the base portion, the biasing portions sharing a longitudinal axis and respectively terminating at a first distal end and a second distal end, the first and second distal ends respectively situated along a first outer conductor portion reference plane and a second outer conductor portion reference plane, the first biasing portion comprising a plurality of first cantilevered beams and a plurality of first slots extending substantially longitudinally from the first distal end for circumferentially spacing the first cantilevered beams apart from one another, the second biasing portion comprising a plurality of second cantilevered beams and a plurality of second slots extending substantially longitudinally from the second distal end for circumferentially spacing the second cantilevered beams apart from one another, wherein the first cantilevered beams are sufficiently resilient to allow sufficient flexure of the first cantilevered beams for inserting the first cantilevered beams through the first terminal housing opening and for receiving the first cantilevered beams against the first inner surface of the first inner receptacle chamber, and wherein the second cantilevered beams are sufficiently resilient to allow sufficient flexure of the second cantilevered beams for inserting the second cantilevered beams through the second terminal housing opening and for receiving the second cantilevered beams against the second inner surface of the second inner receptacle chamber, a cavity insert received in the central bore of the outer conductor portion; and a center conductor portion disposed within the central bore and electrically coupling the first and second center conductors to one another, the center conductor portion comprising a mounting portion supporting the cavity insert and electrically insulating the center conductor portion from the outer conductor portion, the center conductor portion terminating at a first leading end and a second leading end opposite to one another, the first leading end situated along a first center conductor portion reference plane and the second leading end situated along a second center conductor portion reference plane, wherein the first leading end comprises a plurality of first cantilevered tines circumferentially spaced about the longitudinal axis and forming a first central socket therebetween, the plurality of first cantilevered tines and the outer conductor portion forming a first annular cavity therebetween, wherein the plurality of first cantilevered beams and the plurality of first cantilevered tines are spaced apart, wherein the second leading end comprises a plurality of second cantilevered tines circumferentially spaced about the longitudinal axis and forming a second central socket therebetween, the plurality of second cantilevered tines and the outer conductor portion forming a second annular cavity therebetween, wherein the plurality of second cantilevered beams and the plurality of second cantilevered tines are spaced apart.

20. A method for assembling a coaxial transmission medium assembly, comprising:

providing a first coaxial transmission medium having a first end, the first coaxial transmission medium comprising a first center conductor, a first outer conductor, and a first terminal housing, the first center conductor and first center conductor provided in proximity to the first end, the first terminal housing electrically coupled to the first outer conductor and comprising a first inner surface, the first inner surface providing a first inner receptacle chamber and a first terminal housing opening communicating with the first inner receptacle chamber;

providing a second coaxial transmission medium having a second end, the second coaxial transmission medium comprising a second center conductor, second outer conductor, and a second terminal housing, the second center conductor and the second outer conductor provided in proximity to the second end, the second terminal housing coupled to the second outer conductor and comprising a second inner surface, the second inner surface providing a second inner receptacle chamber and a second terminal housing opening communicating with the second inner receptacle chamber;

providing a coaxial transmission medium connector for connecting the first and second coaxial transmission mediums to form a coaxial conduction path, the coaxial transmission medium connector comprising an outer conductor portion for electrically coupling the outer conductors of the first and second coaxial transmission mediums, the outer conductor portion having a central bore and comprising a base portion and first and second biasing portions extending from the base portion, the first and second biasing portions sharing a longitudinal axis and respectively terminating at a first distal end and a second distal end, the first and second distal ends respectively situated along a first outer conductor portion reference plane and a second outer conductor portion reference plane, the first biasing portion comprising a plurality of first cantilevered beams and a plurality of first slots extending substantially longitudinally from the first distal end for circumferentially spacing the first cantilevered beams apart from one another, the second biasing portion comprising a plurality of second cantilevered beams and a plurality of second slots extending substantially longitudinally from the second distal end for circumferentially spacing the second cantilevered beams apart from one another, a cavity insert located in the central bore of the outer conductor portion, and a center conductor portion for electrically coupling the inner conductors of the first and second coaxial transmission mediums, the center conductor portion comprising a mounting portion supporting the cavity insert and electrically insulating the center conductor portion from the outer conductor portion, the center conductor portion terminating at a first leading end and a second leading end opposite to one another, the first leading end situated along a first center conductor portion reference plane and the second leading end situated along a second center conductor portion reference plane, wherein the first leading end comprises a plurality of first cantilevered tines circumferentially spaced about the longitudinal axis and forming a first central socket therebetween, the plurality of first cantilevered tines and the outer conductor portion forming a first annular cavity therebetween, wherein the plurality of first cantilevered beam and the plurality of first cantilevered tines are spaced apart, wherein the second leading end comprises a plurality of second cantilevered tines circumferentially spaced about the longitudinal axis and forming a second central socket therebetween, the plurality of second cantilevered tines and the outer conductor portion forming a second annular cavity therebetween, wherein the plurality of second cantilevered beams and the plurality of second cantilevered tines are spaced apart;

flexing the first cantilevered beams inward and inserting the first cantilevered beams through the first terminal housing opening;

receiving the inwardly flexed first cantilevered beams against the inner surface of the first inner receptacle chamber for electrically coupling the outer conductor portion to the outer conductor of the first coaxial transmission in medium;

electrically coupling the first center conductor to the first leading end of the center conductor portion;

flexing the second cantilevered beams inward and inserting the second cantilevered beams through the second terminal housing opening;

receiving the inwardly flexed second cantilevered beams against the second inner surface of the second inner receptacle chamber for electrically coupling the outer conductor portion to the outer conductor of the second coaxial transmission medium; and electrically coupling the second center conductor to the second leading end of the center conductor portion.

* * * * *